US008135159B2

(12) United States Patent
Liou et al.

(10) Patent No.: US 8,135,159 B2
(45) Date of Patent: Mar. 13, 2012

(54) FLAT PANEL DISPLAY WITH SLIDING LOUDSPEAKER STRUCTURE

(75) Inventors: Guan-De Liou, Taipei (TW); Stephen Tsai, Taipei County (TW); Shau-Yu Huang, Taipei (TW); Li-Li Lai, Taipei (TW)

(73) Assignee: Taylor Made Group, Inc., Gloversville, NY (US)

( * ) Notice: Subject to any disclaimer, the term of this patent is extended or adjusted under 35 U.S.C. 154(b) by 897 days.

(21) Appl. No.: 12/180,585

(22) Filed: Jul. 28, 2008

(65) Prior Publication Data

US 2009/0285438 A1 Nov. 19, 2009

(30) Foreign Application Priority Data

May 15, 2008 (TW) ..... 97117917 A

(51) Int. Cl.
*H04R 1/02* (2006.01)

(52) U.S. Cl. ..... 381/388; 381/386

(58) Field of Classification Search ..... 381/306, 381/333, 386, 387, 388
See application file for complete search history.

(56) References Cited

U.S. PATENT DOCUMENTS

| | | | | |
|---|---|---|---|---|
| 6,794,798 | B2 * | 9/2004 | Watanabe et al. | 310/334 |
| 7,756,286 | B2 * | 7/2010 | Kim | 381/388 |
| 2007/0274547 | A1 * | 11/2007 | Ueno | 381/306 |

* cited by examiner

*Primary Examiner* — Roy Potter
(74) *Attorney, Agent, or Firm* — Ming Chow; Sinorica, LLC

(57) ABSTRACT

The present invention discloses a flat panel display with sliding loudspeaker structure. The flat panel display comprises a display body, a sliding rail, and a sliding loudspeaker portion. The loudspeaker portion comprises a loudspeaker body, a sliding member and a connecting portion. By the matching structure of the sliding member and the sliding rail, the effect of allowing a user to freely adjust the loudspeaker body to different positions can be achieved. Besides, by further using the pivot of the loudspeaker body, the present invention allows the user to freely adjust the loudspeaker to different angular positions. Therefore, the problems of an immovably fixed loudspeaker position and angularly non-adjustable loudspeaker sound field on a conventional display are solved.

16 Claims, 13 Drawing Sheets

FLAT PANEL DISPLAY WITH SLIDING LOUDSPEAKER STRUCTURE

FIELD OF THE INVENTION

The present invention relates to a flat panel display, and more particularly to a flat panel display with sliding loudspeaker structure.

DESCRIPTION OF THE RELATED ART

With the rapid development in scientific technologies, human life quality is improved consequently. The conventional big-size and expensive Cathode Ray Tube (CRT) displays have been gradually replaced by today's light weight and thin liquid crystal displays (LCDs). Among others, portable LCDs allow users to enjoy good audio-visual experience at any time and any place, and are therefore most widely welcomed and accepted.

Conventionally, a flat panel display, such as an LCD television, is provided with two external or internal loudspeaker bodies to achieve the sound effect thereof. However, in the case of internal loudspeaker bodies, since only very limited space is available inside the flat panel display for forming a sound field, the sound quality that can be produced by such loudspeaker body is relatively poor. Further, as the installation of such loudspeaker bodies, a user is not allowed to freely adjust the position and the direction of the loudspeaker bodies according to the user's need. Even though the loudspeaker can provide sound, but the quality of the sound is not satisfied.

On the other hand, while the external loudspeakers can be freely adjusted in position, they are usually located at two lateral sides of the flat panel display, so they will inevitably affect the appearance of the flat panel display. Moreover, when people wish to bring the flat panel display to the outdoors, it is not convenient for user to bring the external loudspeakers since they must be additionally packed and large space would be occupied. Besides, while these equipments are in use or in storage, their wires tend to become tangled and messy, which causes articles to drop or trip over. Further, the user has to search for a usable socket to use.

SUMMARY OF THE INVENTION

In view of this problem, one objective of the present invention is therefore to provide a flat panel display with sliding loudspeaker structure, so as to overcome the problems of an immovable loudspeaker and angularly non-adjustable loudspeaker sound field on a conventional display.

Another objective of the present invention is to provide a flat panel display with sliding loudspeaker structure, comprising a display body, a sliding rail and at least one sliding loudspeaker portion. The display body has a rear surface. The sliding rail is installed on the rear surface of the display body. The sliding loudspeaker portion comprises a sliding member, a loudspeaker body, and a connecting portion. The connecting portion is connected with the sliding member and the loudspeaker body, and the sliding member is movably installed in the sliding rail in a predetermined matching manner.

Preferably, the sliding rail is transversely installed in the rear surface of the display body.

Preferably, the predetermined matching manner can be joint manner, gear driving manner, hydraulic driving manner or tight fit manner.

Preferably, the sliding rail is U-shaped and installed on the rear surface of the display body.

Preferably, the display body can be a liquid crystal display (LCD) television, a plasma display panel (PDP) television, or an organic light emission diode (OLED) television.

Besides, a further objective of the present invention is to provide a flat panel display with sliding loudspeaker structure, comprising a display body, a sliding rail, and at least one sliding loudspeaker portion. The display body has at least one side surface around the display body. The sliding rail is installed on one side surface of the display body. The sliding loudspeaker portion comprises a sliding member, a loudspeaker body and a connecting portion. One end of the connecting portion is connected with the sliding member and the other end is pivotally connected with the loudspeaker body. The sliding member is movably installed in the sliding rail in a predetermined matching manner.

Preferably, the side surface is a longitudinal side surface.

Preferably, and the sliding rail is a longitudinal sliding rail correspondingly installed on the longitudinal side surface.

Preferably, the side surface is a transverse side surface.

Preferably, the sliding rail is a transverse sliding rail correspondingly installed on the transverse side surface.

Preferably, the side surface is a U-shaped side surface.

Preferably, and the sliding rail is a U-shaped sliding rail correspondingly installed on the U-shaped side surface.

Preferably, the predetermined matching manner can be joint manner, gear driving manner, hydraulic driving manner, or tight fit manner.

Preferably, the display body can be a liquid crystal display (LCD) television, a plasma display panel (PDP) television, or an organic light emission diode (OLED) television.

In brief, a flat panel display with sliding loudspeaker structure is provided in the present invention. By means of this matching mechanism between the sliding member and the sliding rail, the effect of fulfilling a user's need to freely adjust the loudspeaker body to different positions can be achieved. Furthermore, the function of freely adjusting the angles of the loudspeaker can also be achieved with the pivot of the loudspeaker body. Therefore, the problems of an immovable loudspeaker and angularly non-adjustable loudspeaker sound field on a conventional display are solved.

BRIEF DESCRIPTION OF THE DRAWINGS

The structure and the technical means adopted by the present invention to achieve the above and other objectives can be best understood by referring to the following detailed description of the preferred embodiments and the accompanying drawings, wherein.

DETAILED DESCRIPTION OF THE PREFERRED EMBODIMENTS

FIGS. 1 to 7 illustrate the first embodiment of the flat panel display of the present invention. A flat panel display 10 of the present invention comprises a display body 110, a sliding rail 120, and at least one sliding loudspeaker portion 130 or 140. Preferably, the display body 110 can be a liquid crystal display (LCD) television, a plasma display panel (PDP) television, or an organic light emission diode (OLED) television.

Figure 1:
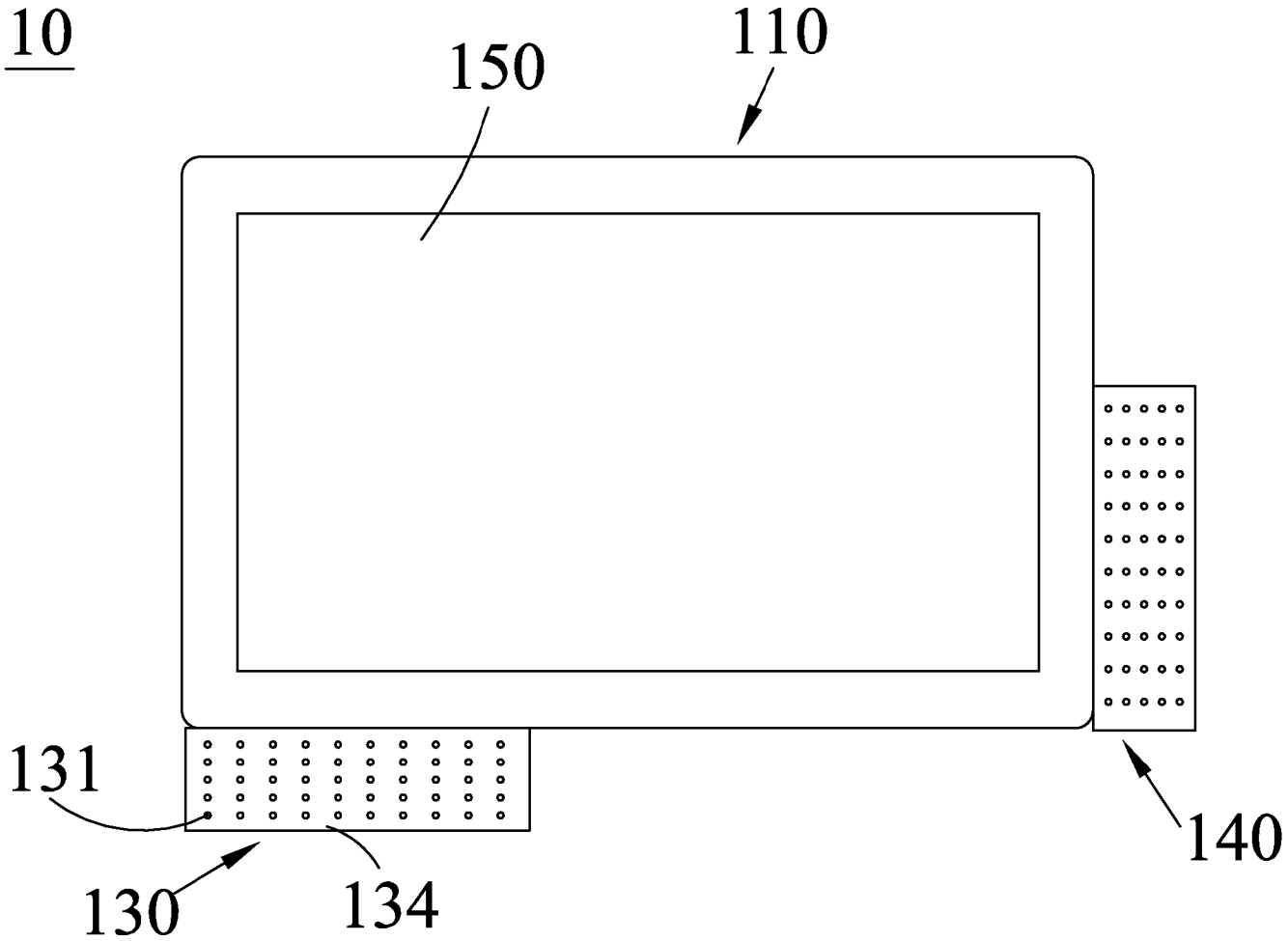
FIG. 1 is a front view of the first embodiment of a flat panel display with sliding loudspeaker structure of the present invention.
Figure 2:
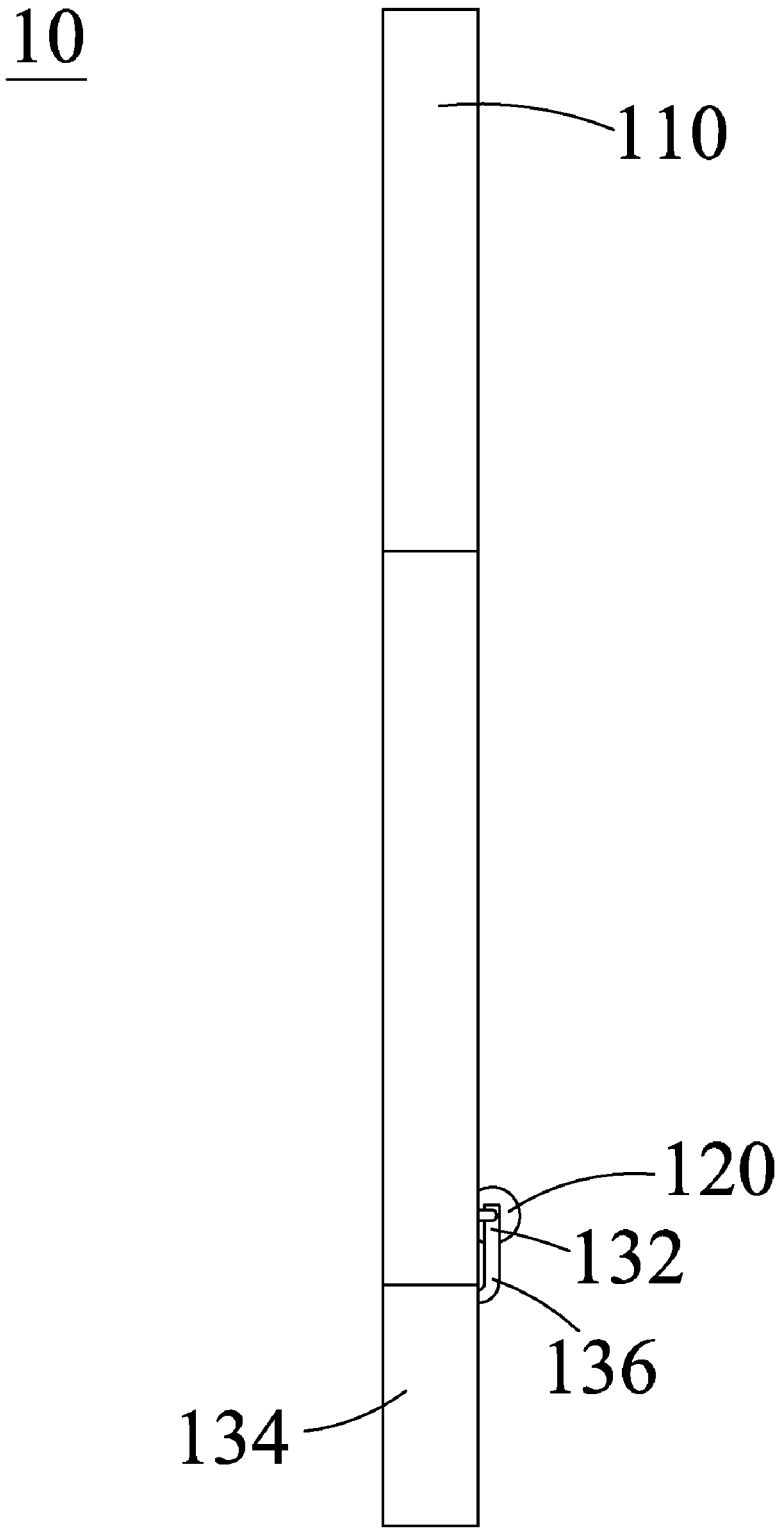
FIG. 2 is a right side view of the first embodiment of the flat panel display with sliding loudspeaker structure of the present invention.
Figure 3:
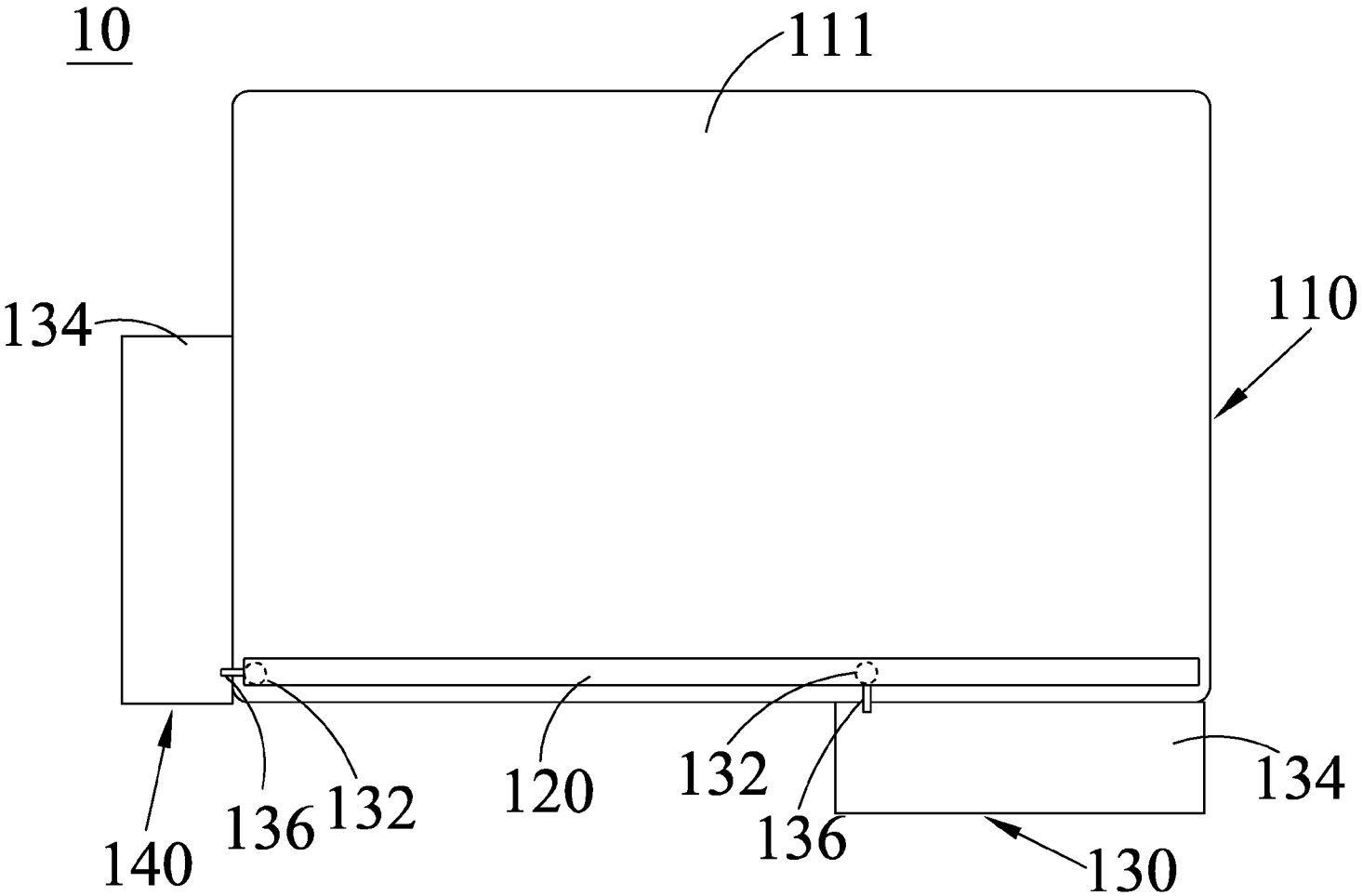
FIG. 3 is a rear view of the flat panel display of the first embodiment of the present invention.

Referring to FIGS. 1~3, the display body 110 comprises a screen 150 and a rear surface 111. The sliding rail 120 is transversely installed on the rear surface 111 of the display body 110. In this embodiment, two sliding loudspeaker portions, namely, a first sliding loudspeaker portion 130 and a second loudspeaker portion 140 are installed on the display body 110. The first sliding loudspeaker portion 130 comprises a sliding member 132, a loudspeaker body 134, and a connecting portion 136. The connecting portion 136 one end is connected to the sliding member 132 and the other end connected to the loudspeaker body 134, and the sliding member 132 is movably installed in the sliding rail 120 in a matching manner. In addition, as shown in FIG. 1, a plurality of sound apertures 131 are disposed on the loudspeaker body 134 for distributing audio sound. The structure of the second loudspeaker portion 140 is substantially identical to the first loudspeaker portion 130, and is therefore not described in details herein. In this embodiment, the sliding member 132 is a spherical sliding member. The sliding rail 120 can be protruded from or concave in the rear surface 111 of the display body 110. In the first embodiment, the sliding rail 120 is protruded from the rear surface 111 to joint the ball-shaped sliding member 132, so that the sliding member 132 is slide-jointed in the sliding rail 120 to freely move horizontally. While the sliding member 132 is moved to either end of the sliding rail 120, the sliding loudspeaker portion 130 and 140 can be rotated toward a vertical direction as shown in FIG. 3. However, the sliding rail 120 and the sliding member 132 can also be matched with one another in other manners. For example, the sliding member 132 can be movably installed in the sliding rail 120 in gear driving manner, tight fit manner, hydraulic driving manner, etc. Therefore, any means that enable the sliding member 132 to move freely horizontally in the sliding rail 120 are within the protective scope of the present invention.

Figure 4:
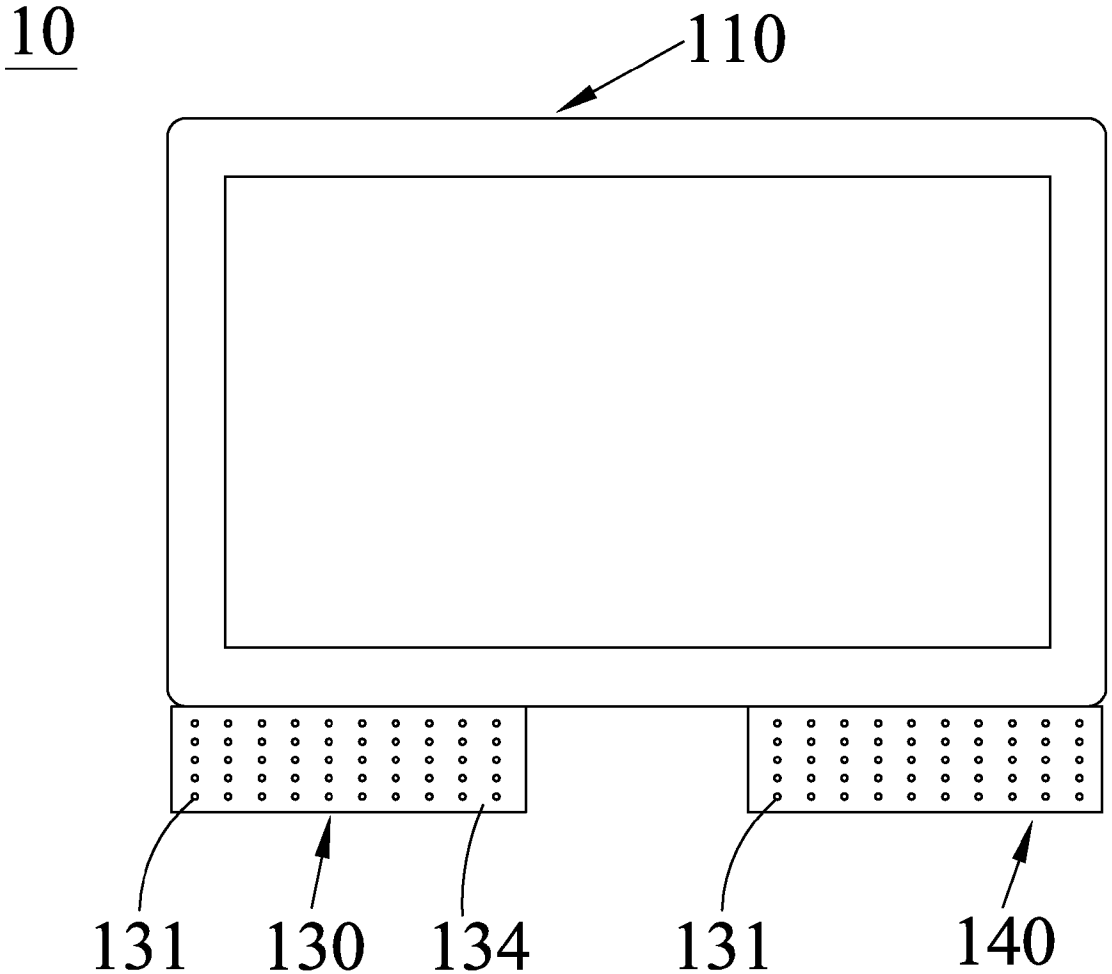
FIG. 4 is a schematic view of the first operating state of the first embodiment of the flat panel display of the present invention.

FIG. 4 illustrates the first operating state of the first embodiment. In first state, the first loudspeaker portion 130 and the second loudspeaker portion 140 are slid to a lower side of the display body 110.

Figure 5:
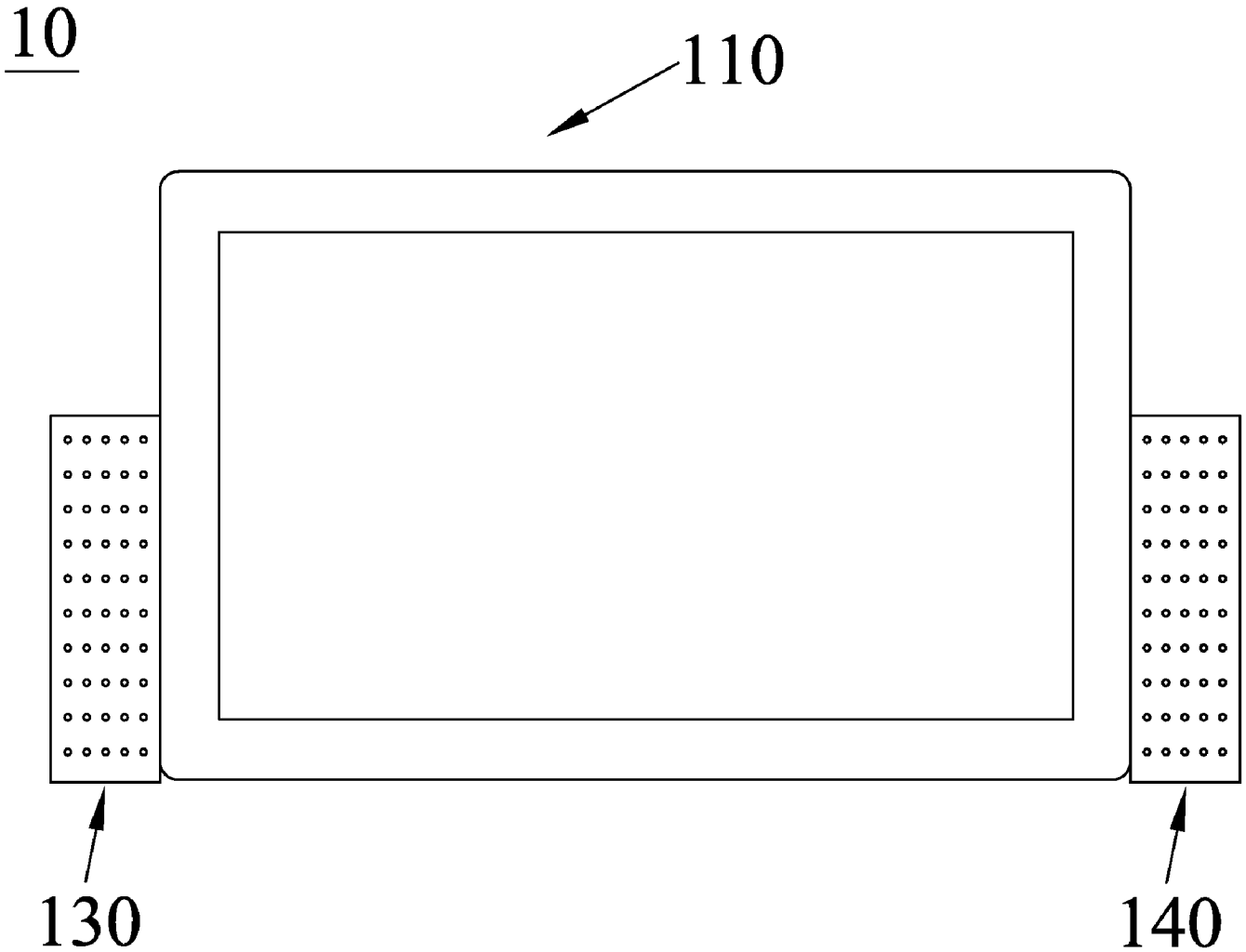
FIG. 5 is a schematic view of the second operating state of the first embodiment of the flat panel display of the present invention.

FIG. 5 shows the second operating state of the first embodiment. In second state, the first loudspeaker portion 130 and the second loudspeaker portion 140 are respectively slid to two lateral sides of the display body 110.

Figure 6:
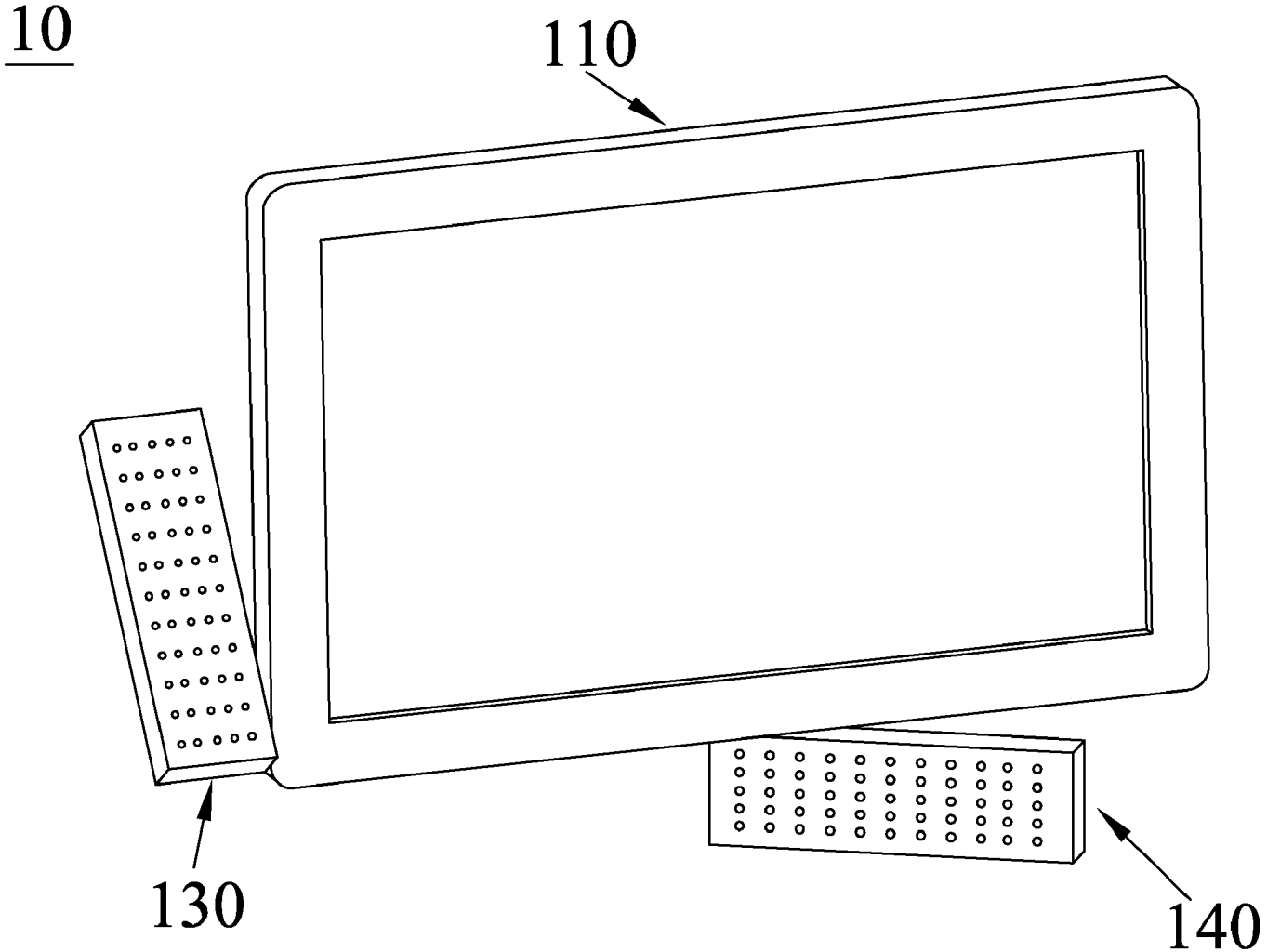
FIG. 6 is a schematic view of the third operating state of the first embodiment of the flat panel display of the present invention.

FIG. 6 illustrates the third operating state of the first embodiment. In third state, the first loudspeaker portion 130 and the second loudspeaker portion 140 are respectively slid to a lateral side and a lower side of the display body 110, and both loudspeaker portions 130 and 140 can be freely rotated forward and backward.

Figure 7:
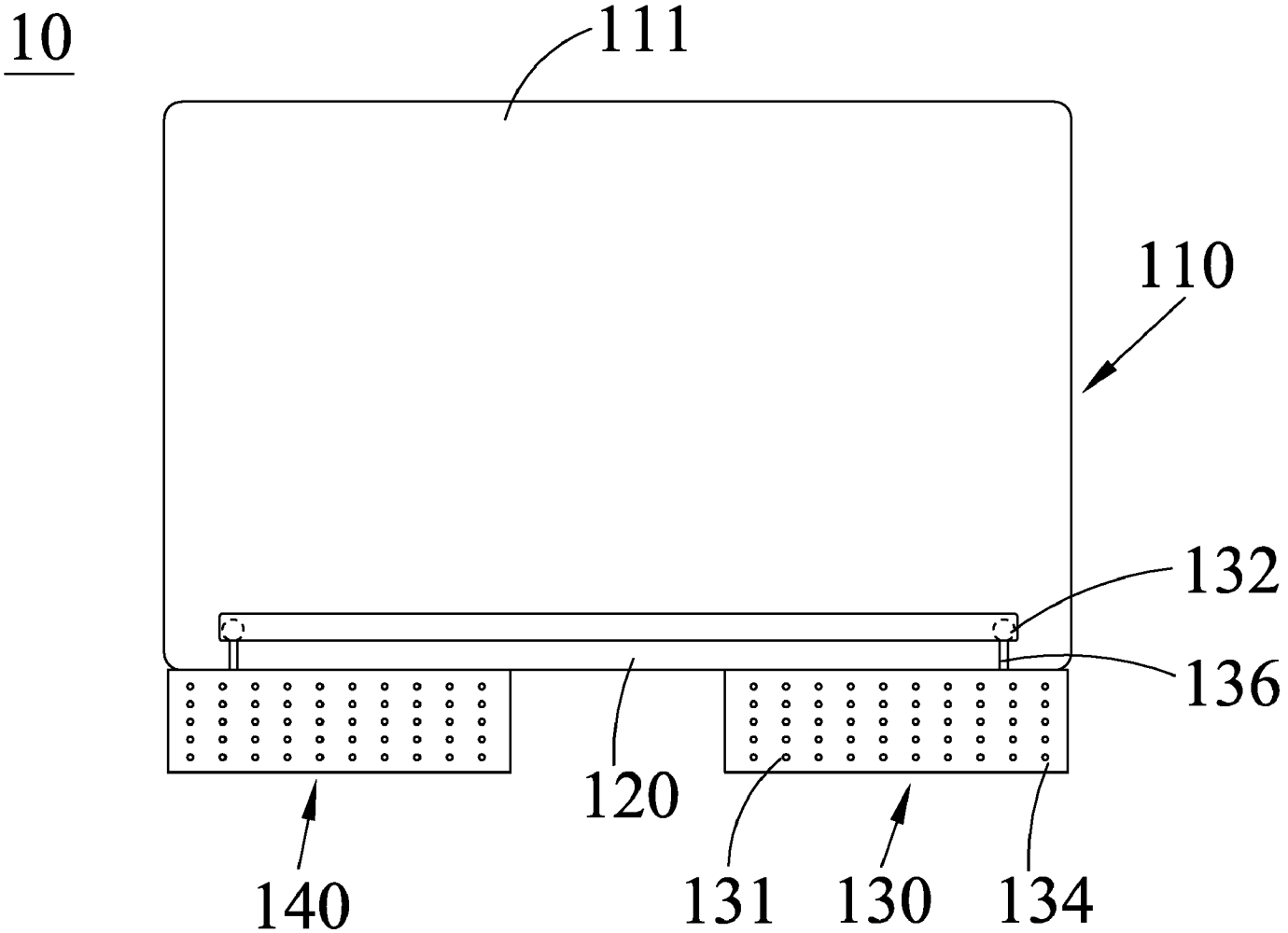
FIG. 7 is a schematic view of the fourth operating state of the first embodiment of the flat panel display of the present invention.

Referring to FIG. 7, while the flat panel display 10 is used in site for meeting or lecture, depending on demand, the loudspeaker body 134 can be rotated around facing the rear of the screen, so that the sound from loudspeaker can directly project to those audiences behind the screen. The second loudspeaker portion 140 can be operated for use in the same manner as the first loudspeaker portion 130, and is therefore not described in details herein.

Figure 8:
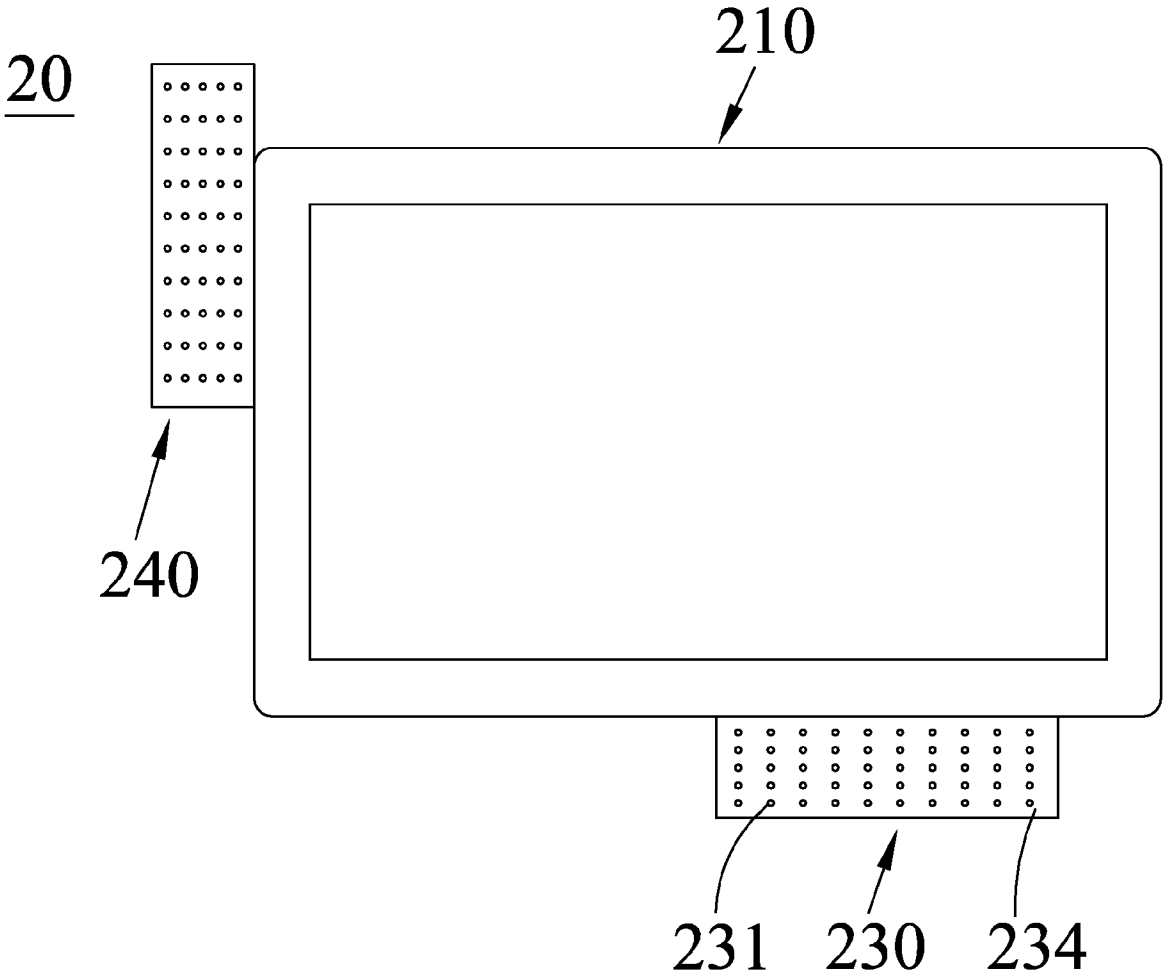
FIG. 8 is a front view of the second embodiment of a flat panel display of the present invention.
Figure 9:
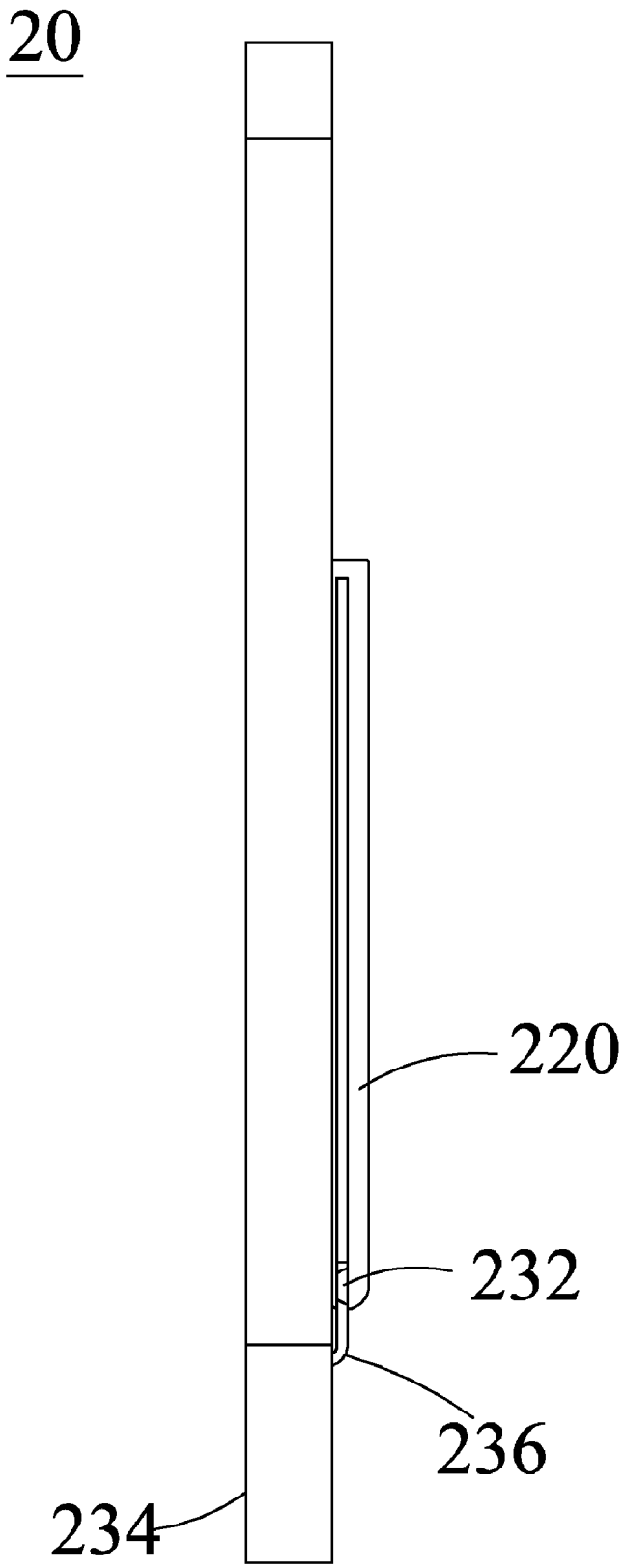
FIG. 9 is a right side view of the second embodiment of the flat panel display of the present invention.
Figure 10:
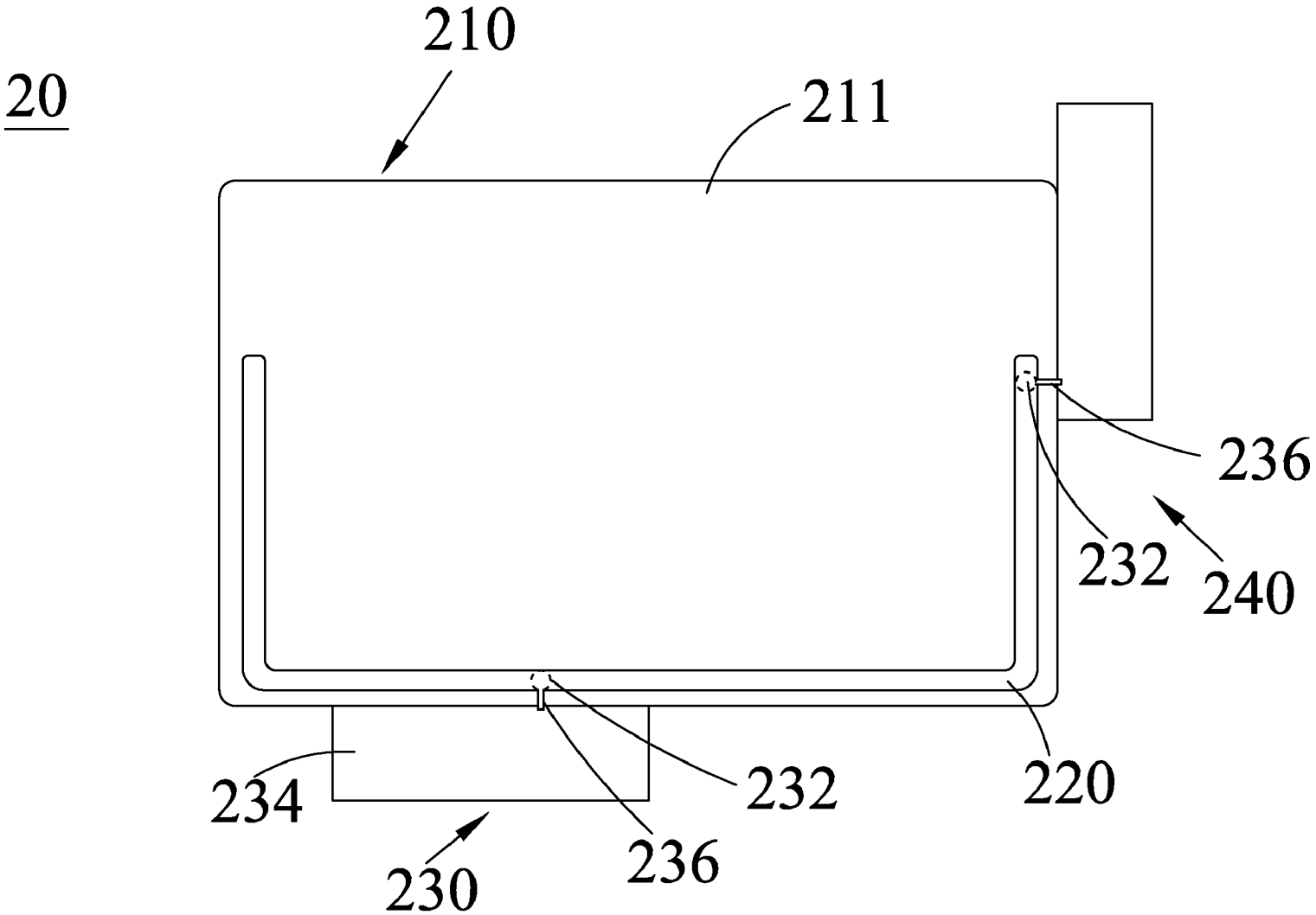
FIG. 10 is a rear view of the second embodiment of the flat panel display of the present invention.

FIGS. 8~10 illustrate the second embodiment of the present invention. The flat panel display 20 of the present invention comprises a display body 210, a sliding rail 220, and at least one sliding loudspeaker portion 230 or 240. Preferably, the display body 210 can be a liquid crystal display (LCD) television, a plasma display panel (PDP) television, or an organic light emission diode (OLED) television.

Referring to FIGS. 9 and 10, the display body 210 has a rear surface 211. The sliding rail 220 is in the form of U shape installed on the rear surface 211 of the display body 210. In this embodiment, two sliding loudspeaker portions, namely, a first sliding loudspeaker portion 230 and a second loudspeaker portion 240 are installed on the display body 210. The first sliding loudspeaker portion 230 comprises a sliding member 232, a loudspeaker body 234 and a connecting portion 236. The connecting portion 236 one end is connected to the sliding member 232 and the other end connected to the loudspeaker 234, and the sliding member 232 is freely movably installed in the sliding rail 220. In addition, as shown in FIG. 8, a plurality of sound apertures 231 are disposed on the loudspeaker 234 for distributing audio sound. The structure of second loudspeaker portion 240 is substantially identical to the first loudspeaker portion 230, and is therefore not described in details herein. In this embodiment, the sliding member 232 is a spherical sliding member. The sliding rail 220 can be protruded from or concave in the display body 210. Here, the sliding rail 220 is protruded from the rear surface 211 to joint the ball-shaped sliding member 232, so that the sliding member 232 can be jointed in the U-shaped sliding rail 220 to freely slide horizontally and vertically in the sliding rail 220. However, the sliding rail 220 and the sliding member 232 can also be matched with one another in other manners. For example, the sliding member 232 can be movably installed in the sliding rail 220 in gear driving manner, tight fit manner, hydraulic driving manner, etc. Therefore, any means that enable the sliding member 232 to move freely horizontally and vertically in the sliding rail 220 are within the protective scope of the present invention.

The operating state of the loudspeaker body 234 in this embodiment can be the same as FIGS. 4~7 of aforementioned embodiment. Therefore, the loudspeaker body 234 and the connecting portion 236 can be moved horizontally and vertically in the sliding rail 220 or rotated forward or backward by the sliding member 232. While the flat panel display 20 is used in a site for meeting or lecture, depending on demand, the loudspeaker body 234 of the first loudspeaker portion 230 can be rotated around facing rear of the screen, so that sound from the loudspeaker body 234 can directly project to those audiences behind the screen. The second loudspeaker portion 240 can be operated for use in the same manner as the first loudspeaker portion 230, and is therefore not described in details herein.

Figure 11:
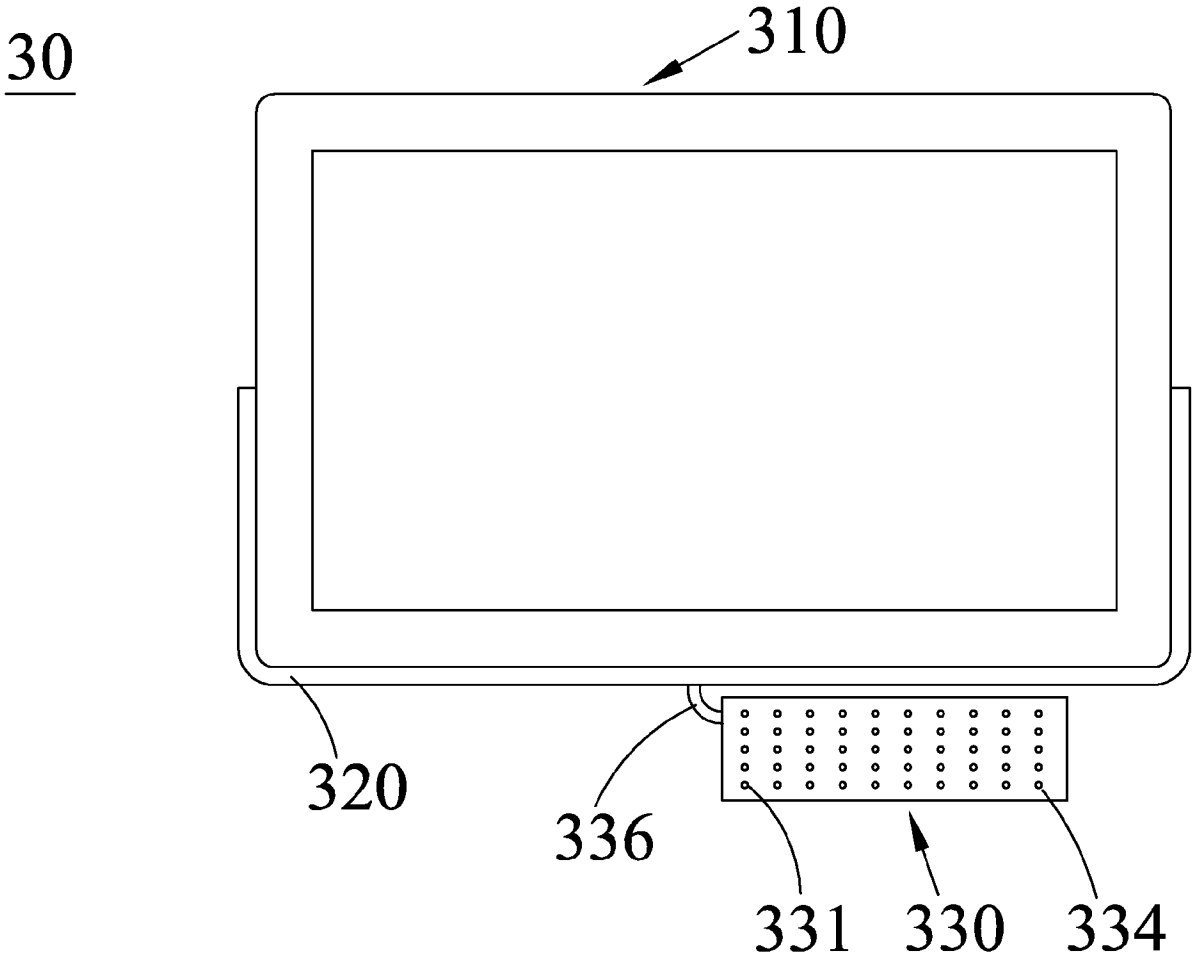
FIG. 11 is a front view of the third embodiment of a flat panel display of the present invention.
Figure 12:
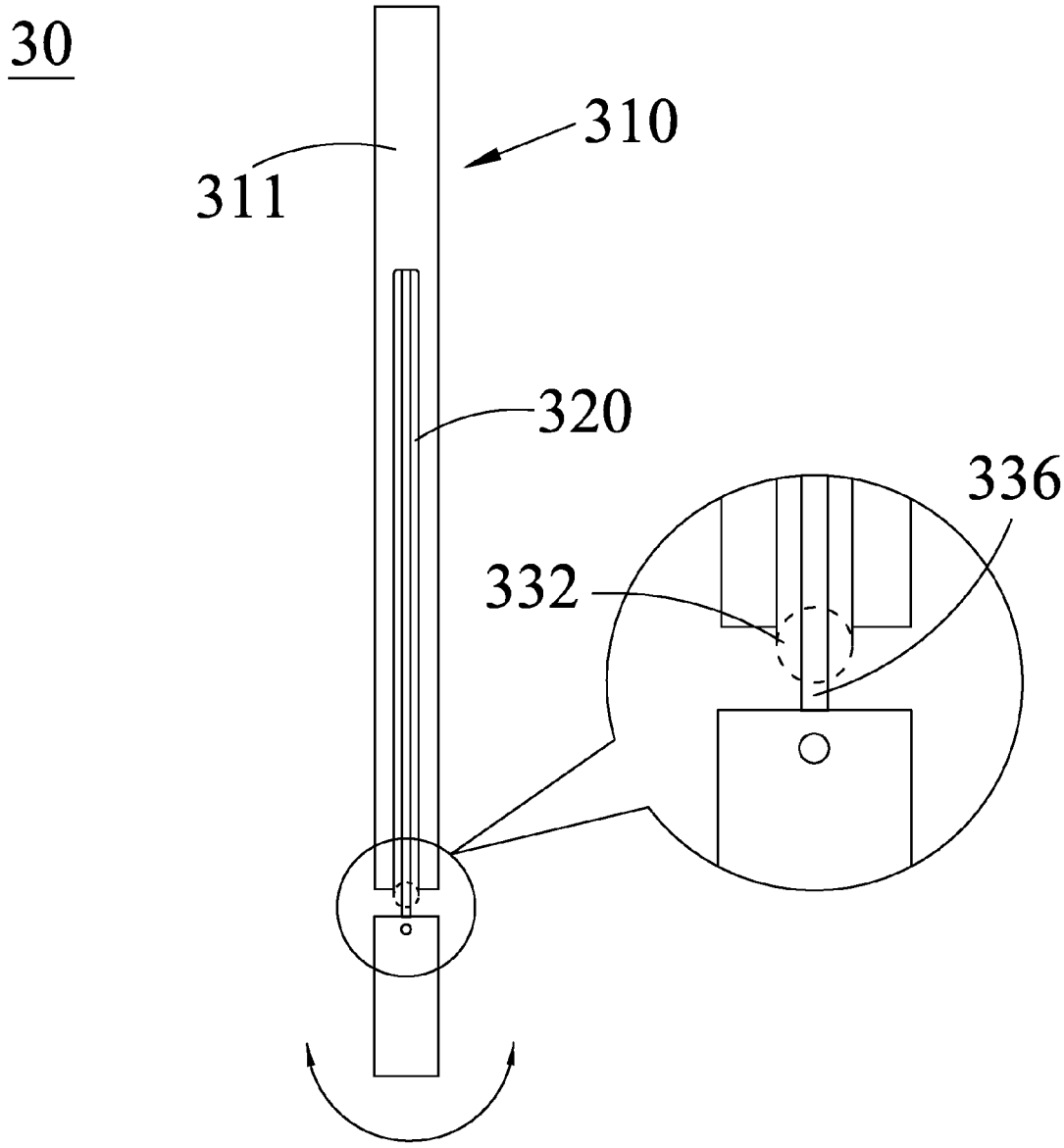
FIG. 12 is a right side view of the third embodiment of the flat panel display of the present invention.
Figure 13:
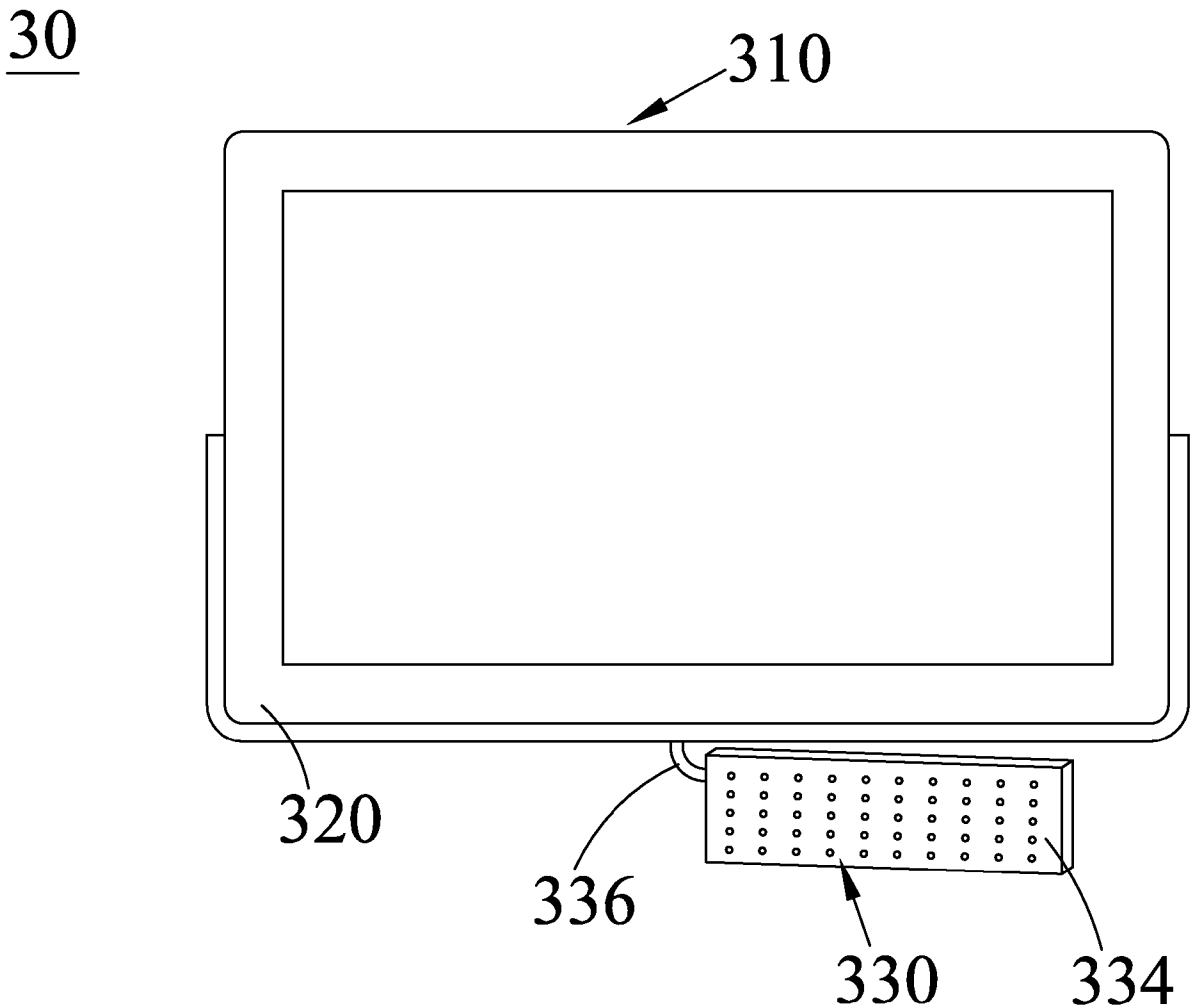
FIG. 13 is a schematic diagram of the operating state of the third embodiment of the flat panel display of the present invention.

FIGS. 11~13 illustrate a third embodiment of the present invention. The flat panel display 30 comprises a display body 310, a sliding rail 320, and at least one sliding loudspeaker portion 330. The display body 310 can be a liquid crystal display (LCD) television, a plasma display panel (PDP) television, or an organic light emission diode (OLED) television.

Referring to FIGS. 11 and 12, the display body 310 has at least one side surface 311 around the display body 310. The side surface 311 can be a transverse side surface, a longitudinal side surface, or a U-shaped side surface. The sliding rail 320 is installed on the side surface 311 of the display body 310, and can be a transverse sliding rail, a longitudinal sliding rail, or a U-shaped sliding rail corresponding to the transverse side surface, the longitudinal side surface, or the U-shaped side surface. The sliding loudspeaker portion 330 comprises a sliding member 332, a loudspeaker body 334 and a connecting portion 336. One end of the connecting portion 336 is connected with the sliding member 332, and the other end is pivotally connected to the loudspeaker body 334. The sliding member 332 is movably installed in the sliding rail 320 in a matching manner. Besides, a plurality of sound apertures 331 are disposed on the loudspeaker body 334 for distributing audio sound. In this embodiment, the sliding member 332 is in the form of a ball-shaped and the sliding rail 320 is a U-shaped sliding rail. The sliding rail 320 can be protruded from or concave in the side surface 311 of the display body 310. In this embodiment, the sliding rail 320 is protruded from the side surface 311 to joint the sliding member 332, so that the sliding member 332 can match with the U-shaped sliding rail 320 to freely slide horizontally and vertically in the sliding rail 320. However, the sliding rail 320 and the sliding member 332 can also be engaged with one another in other manners. For example, the sliding member 332 can be movably installed in the sliding rail 320 in gear driving manner, tight fit manner, hydraulic driving manner, etc. Therefore, any means that enable the sliding member 332 to move freely sidewardly and vertically in the sliding rail 320 are within the protective scope of the present invention.

The operating state of the loudspeaker body 334 in this embodiment can be the same as FIGS. 4~7 of the aforementioned embodiment. Therefore, the loudspeaker body 334 and the connecting portion 336 can be moved freely horizontally and vertically in the sliding rail 320 and pivotally rotated forward or backward by the sliding member 332. When a user transversely slides the loudspeaker 334 to the end of the U-shape sliding rail 320, since the sliding member 332 can rotate in the sliding rail 320, thereby the loudspeaker portion 330 can be turned from a horizontal position into a vertical position, and slid vertically along the U-shaped sliding rail 320. When the flat panel display 30 is used in a site for meeting or lecture, depending on demand, the loudspeaker body 334 can be pivotally rotated around facing the rear of the screen, so that sound from loudspeaker body 334 can directly distributes to those audiences behind the screen for better hearing experience.

Referring to FIG. 13, one end of the connecting portion 336 is pivotally connected with the loudspeaker 334 for allowing the loudspeaker body 334 to be pivotally rotated forward and backward by this pivot structure, as indicated in the direction of the arrow in FIG. 12. In this manner, a user can turn the loudspeaker body 334 to different angular positions according to his/her demand.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A flat panel display with sliding loudspeaker structure, comprising:
   a display body having a rear surface;
   a sliding rail installed on the rear surface of the display body; and
   at least one sliding loudspeaker portion comprising a sliding member, a loudspeaker body and a connecting portion, wherein the sliding rail is U-shaped and installed on the rear surface of the display body; the connecting portion is connected with the sliding member and the loudspeaker body, and the sliding member is movably installed in the sliding rail in a predetermined matching manner.

2. The flat panel display with sliding loudspeaker structure as claimed in claim 1, wherein the sliding rail is transversely installed on the rear surface of the display body.

3. The flat panel display with sliding loudspeaker structure as claimed in claim 1, wherein the predetermined matching manner is a joint manner.

4. A flat panel display with sliding loudspeaker structure, comprising:
   a display body having a rear surface;
   a sliding rail installed on the rear surface of the display body; and
   at least one sliding loudspeaker portion comprising a sliding member, a loudspeaker body and a connecting portion, wherein the connecting portion is connected with the sliding member and the loudspeaker body, and the sliding member is movably installed in the sliding rail in a predetermined matching manner, and the predetermined matching manner is a gear driving manner or a hydraulic driving manner.

5. The flat panel display with sliding loudspeaker structure as claimed in claim 1, wherein the predetermined matching manner is a tight fit manner.

6. The flat panel display with sliding loudspeaker structure as claimed in claim 1, wherein the display body can be a liquid crystal display (LCD) television, a plasma display panel (PDP) television, or an organic light emission diode (OLED) television.

7. A flat panel display with sliding loudspeaker structure, comprising:
   a display body having at least one side surface around the display body;
   a sliding rail installed on one of the at lease one side surface of the display body; and
   at least one sliding loudspeaker portion comprising a sliding member, a loudspeaker body and a connecting portion, wherein the side surface is a U-shaped side surface; one end of the connecting portion is connected with the sliding member and the other end is pivotally connected with the loudspeaker body, and the sliding member is movably installed in the sliding rail in a predetermined matching manner.

8. The flat panel display with sliding loudspeaker structure as claimed in claim 7, wherein the side surface is a longitudinal side surface.

9. The flat panel display with sliding loudspeaker structure as claimed in claim 8, wherein the sliding rail is a longitudinal sliding rail correspondingly installed on the longitudinal side surface of the display body.

10. The flat panel display with sliding loudspeaker structure as claimed in claim 7, wherein the side surface is a transverse side surface.

11. The flat panel display with sliding loudspeaker structure as claimed in claim 10, wherein the sliding rail is a transverse sliding rail correspondingly installed on the transverse side surface of the display body.

12. The flat panel display with sliding loudspeaker structure as claimed in claim 7, wherein the sliding rail is a U-shaped sliding rail correspondingly installed on the U-shaped side surface of the display body.

13. The flat panel display with sliding loudspeaker structure as claimed in claim 7, wherein the predetermined matching manner is a joint manner.

14. A flat panel display with sliding loudspeaker structure, comprising:

a display body having at least one side surface around the display body;

a sliding rail installed on one of the at lease one side surface of the display body; and at least one sliding loudspeaker portion comprising a sliding member, a loudspeaker body and a connecting portion, wherein one end of the connecting portion is connected with the sliding member and the other end is pivotally connected with the loudspeaker body, and the sliding member is movably installed in the sliding rail in a predetermined matching manner, and the predetermined matching manner is a gear driving manner or a hydraulic driving manner.

15. The flat panel display with sliding loudspeaker structure as claimed in claim 7, wherein the predetermined matching manner is a tight fit manner.

16. The flat panel display with sliding loudspeaker structure as claimed in claim 7, wherein the display body can be a liquid crystal display (LCD) television, a plasma display panel (PDP) television, or an organic light emission diode (OLED) television.

* * * * *

UNITED STATES PATENT AND TRADEMARK OFFICE

CERTIFICATE OF CORRECTION

PATENT NO. : 8,135,159 B2
APPLICATION NO. : 12/180585
DATED : March 13, 2012
INVENTOR(S) : Guan-De Liou et al.

It is certified that error appears in the above-identified patent and that said Letters Patent is hereby corrected as shown below:

Title Page, (73) the "Assignee: Taylor Made Group, Inc., Gloversville, NY (US)" should read
--- Assignee: HANNSPREE, INC., Taipei, Taiwan (TW) ---

Signed and Sealed this
Seventeenth Day of November, 2015

Michelle K. Lee

Michelle K. Lee
*Director of the United States Patent and Trademark Office*